US012134541B2

(12) United States Patent
Dowd et al.

(10) Patent No.: US 12,134,541 B2
(45) Date of Patent: Nov. 5, 2024

(54) CABLE REEL

(71) Applicant: Technology Container Corp., Desoto, TX (US)

(72) Inventors: Fred Dowd, Princeton, MA (US); Roger L Cleveland, Jr., Arlington, TX (US); Jack David Hartman, McKinney, TX (US)

(73) Assignee: TECHNOLOGY CONTAINER CORP., Desoto, TX (US)

( * ) Notice: Subject to any disclaimer, the term of this patent is extended or adjusted under 35 U.S.C. 154(b) by 72 days.

(21) Appl. No.: 17/979,854

(22) Filed: Nov. 3, 2022

(65) Prior Publication Data

US 2023/0138933 A1 May 4, 2023

Related U.S. Application Data

(60) Provisional application No. 63/275,100, filed on Nov. 3, 2021.

(51) Int. Cl.
*B65H 75/44* (2006.01)
*B65H 75/14* (2006.01)

(52) U.S. Cl.
CPC ..... *B65H 75/44* (2013.01); *B65H 75/14* (2013.01); *Y10T 137/6929* (2015.04)

(58) Field of Classification Search
CPC ..... B65H 75/14; B65H 75/146; B65H 75/44; B65H 75/00; B65H 75/2245; B65H 2701/5112; Y10T 137/6929
See application file for complete search history.

(56) References Cited

U.S. PATENT DOCUMENTS 492,657 A * 2/1893 Bohringer ..... B65H 75/14 242/118.8
1,448,355 A 3/1923 Bowen
1,559,561 A * 11/1925 Edinger ..... B65H 75/146 242/603
2,092,731 A * 9/1937 Foukal ..... B65H 75/14 242/608.8
3,278,135 A 10/1966 Black
(Continued)

FOREIGN PATENT DOCUMENTS

WO WO-2007035999 A1 * 4/2007 ..... B65H 75/146

*Primary Examiner* — Jessica Cahill
(74) *Attorney, Agent, or Firm* — KRIEGSMAN & KRIEGSMAN

(57) ABSTRACT

A cable reel for retaining a continuous length of cable is preferably constructed using an inexpensive plastic material, such as corrugated plastic. In one embodiment, the cable reel includes a hollow tubular core with a set of outward radial tabs integrally formed at each of its ends. A single, disc-shaped, interior support flange is mounted within the interior of the core in circumferential contact therewith to provide structural rigidity. Additionally, on each end of the core, an annular inner flange and a disc-shaped outer flange are disposed in coaxial alignment with one another against opposing surfaces of its corresponding set of radial tabs and are fixedly secured together as part of the assembly process. The multi-flange construction enables the thickness, diameter and/or material properties of the ends of the cable reel to be adjusted, as needed, to accommodate the strength and dimensional requirements of the intended application.

9 Claims, 14 Drawing Sheets

(56) References Cited

U.S. PATENT DOCUMENTS

| | | | | |
|---|---|---|---|---|
| 3,412,847 | A | 11/1968 | Wise et al. | |
| 3,827,651 | A | 8/1974 | Benson et al. | |
| 3,876,073 | A | 4/1975 | Herbetko | |
| 4,667,896 | A * | 5/1987 | Frey | B65H 75/18 242/165 |
| 6,234,421 | B1 * | 5/2001 | Cox | B65H 75/14 242/588 |
| 2007/0262192 | A1 | 11/2007 | Derendal | |
| 2010/0264246 | A1 | 10/2010 | Ries | |

* cited by examiner

CABLE REEL

CROSS-REFERENCE TO RELATED APPLICATIONS

The present invention claims the benefit under 35 U.S.C. 119(e) to U.S. Provisional Patent Application No. 63/275,100, which was filed on Nov. 3, 2021, in the names of Fred Dowd et al., the disclosure of which is incorporated herein by reference.

FIELD OF THE INVENTION

The present invention relates generally to the storage of cables and, more particularly, to reels around which cables are wound for storage and ease of dispensing.

BACKGROUND OF THE INVENTION

A cable reel is a spool-like member around which an elongated product is tightly wound for compact storage and ease of dispensing. Most commonly, cable reels are designed to retain an item with a continuous filament-like construction, such as an elongated length of cable, wire, thread, fiber, or the like.

Cable reels are commonly adapted to receive a longitudinal crossbar, or spindle, which is in turn mounted onto a reel dispenser or rack. Pulling the free end of the product causes the cable reel to rotate about the spindle on which it is rotatably mounted. As such, a measured length of the product can be easily drawn from the reel and subsequently severed from the remainder of the supply to complete the dispensing process.

A traditional cable reel is constructed to include a tubular core, or drum, and a pair of disc-shaped flanges which are fixedly mounted on opposite ends of the drum. As such, an elongated cable is adapted to be wound onto the outer surface of the drum, with the pair of opposing flanges retaining the cable in place (i.e., preventing lateral displacement past either end of the core).

Although known in the art, traditional cable reels of the type as described above been found to suffer from a couple notable shortcomings.

As a first shortcoming, traditional cable reels of the type as described above are most commonly manufactured using wood, metal, or paper, which are all relatively expensive materials. Cable reels constructed of plastic are known in the art and are typically less expensive to manufacture. However, plastic cable reels have been found to be of limited strength and therefore are typically restricted to use in lightweight applications (e.g., cables of limited length and/or weight).

As a second shortcoming, a traditional cable reel of the type as described above is typically fixed in its construction with respect to certain material properties as well as overall dimensions. As a result, conventional cable reels are incapable of being modified in strength and/or size to accommodate significant variances between intended applications.

SUMMARY OF THE INVENTION

In view thereof, it is an object of the present invention to provide a novel cable reel on which can be wound a length of cable or other similar continuous filament-like item, such as wire, thread, fiber or the like.

It is another object of the present invention to provide a cable reel of the type as described above which has a limited number of parts, is constructed using inexpensive materials, and is easy to assemble.

It is yet another object of the present invention to provide a cable reel of the type as described above which is durable, sizable, and strong, thereby rendering it suitable for use with relatively long and/or heavyweight products.

It is still another object of the present invention to provide a cable reel of the type as described above which can be readily modified in strength and/or size to accommodate significant variances between intended applications.

Accordingly, as one feature of the present invention, there is provided a cable reel for retaining a length of product, the cable reel comprising (a) a tubular core comprising (i) a cylindrical barrel shaped to define an interior cavity, the barrel comprising an inner surface, an outer surface, a first end, and a second end, (ii) a first set of radial tabs formed on the first end of the barrel, each of the first set of radial tabs having an inner surface and an outer surface, and (iii) a second set of radial tabs formed on the second end of the barrel, each of the second set of radial tabs having an inner surface and an outer surface, (b) first and second inner flanges coaxially mounted on the barrel of the tubular core, the first inner flange disposed flush against the inner surface of the first set of radial tabs and the second inner flange disposed flush against the inner surface of the second set of radial tabs, and (c) first and second outer flanges, the first outer flange disposed flush against the outer surface of the first set of radial tabs and the second outer flange disposed flush against the outer surface of the second set of radial tabs, (d) wherein the first inner flange is fixedly secured to the first outer flange with the first set of radial tabs sandwiched therebetween and the second inner flange is fixedly secured to the second outer flange with the second set of radial tabs sandwiched therebetween.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings, wherein like reference numerals represent like parts.

DETAILED DESCRIPTION OF THE INVENTION

Cable Reel 11

Figure 1A:
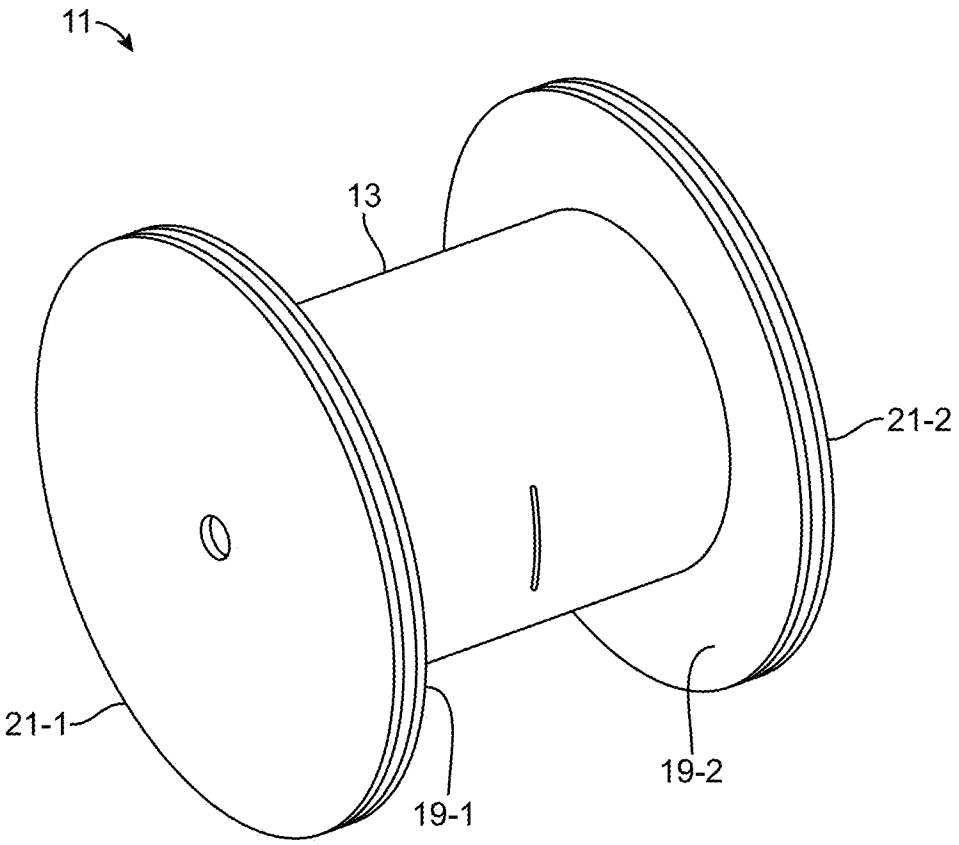
FIGS. 1(*a*) and 1(*b*) are assembled, front perspective and exploded, front perspective views, respectively, of a first embodiment of a cable reel constructed according to the teachings of the present invention.
Figure 1B:
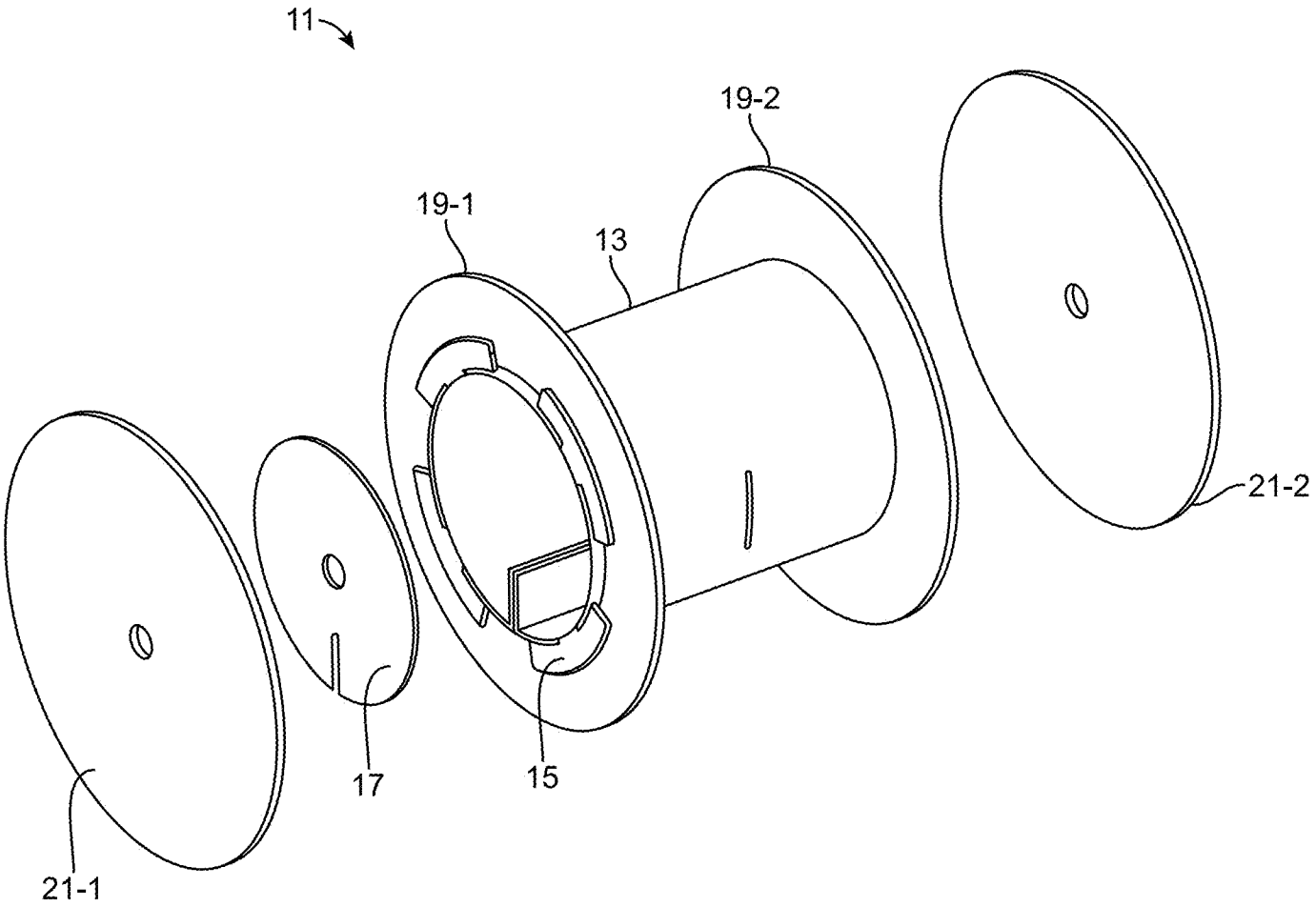
Figure 2A:
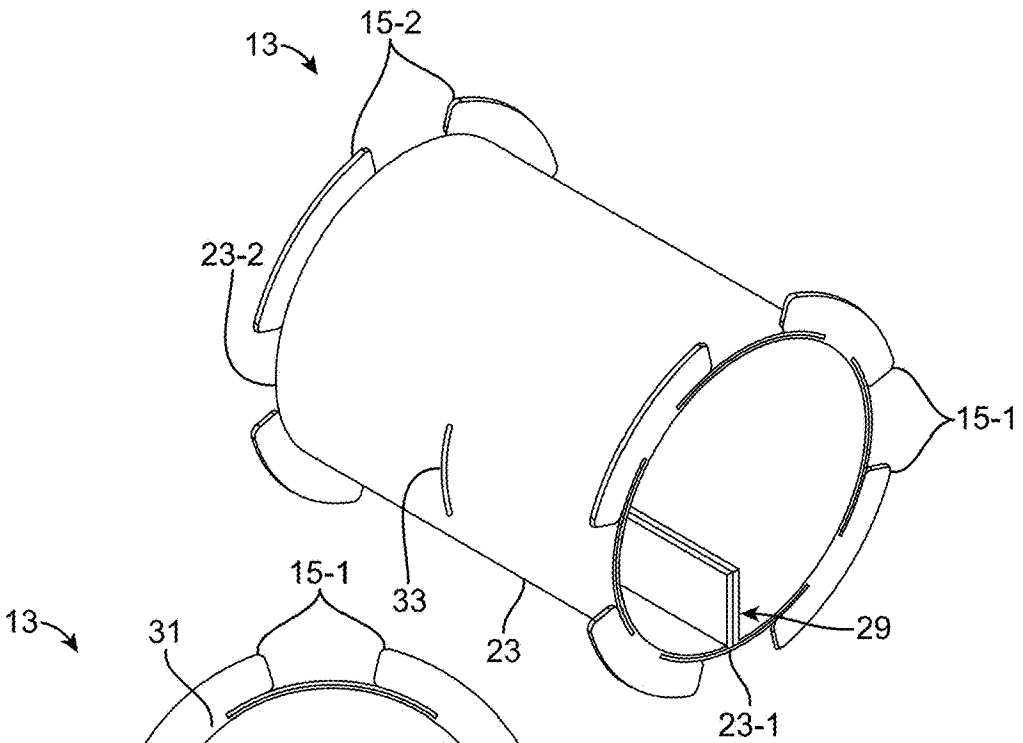
FIGS. 2(*a*)-2(*d*) are rear perspective, left end, front, and bottom views, respectively, of the tubular core shown in FIG. 1(*b*)
Figure 2B:
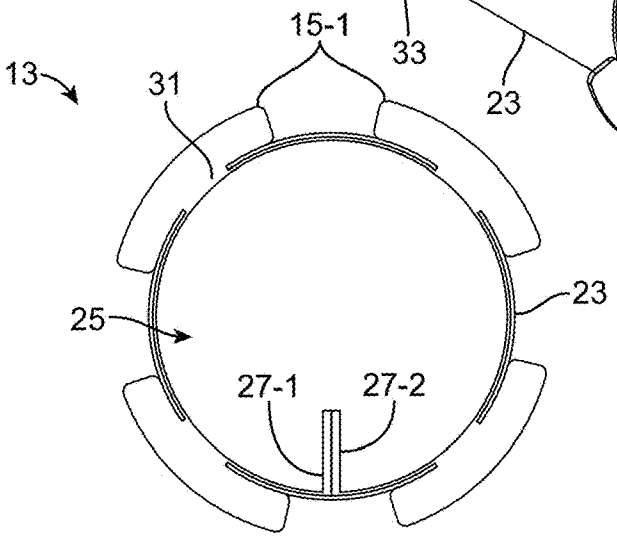
Figure 2C:
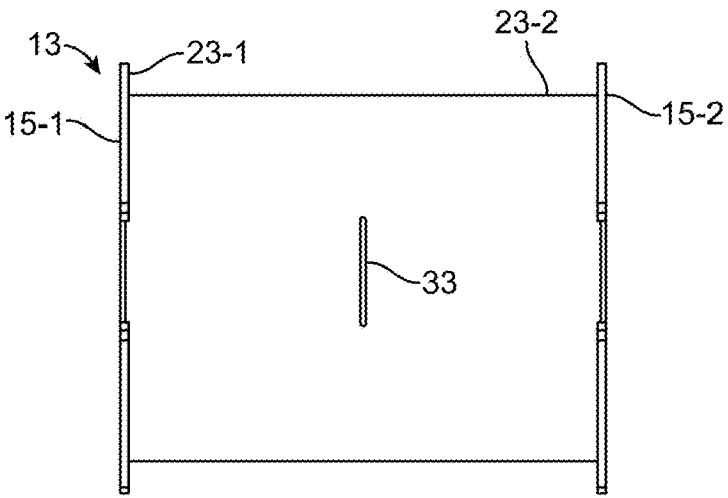
Figure 2D:
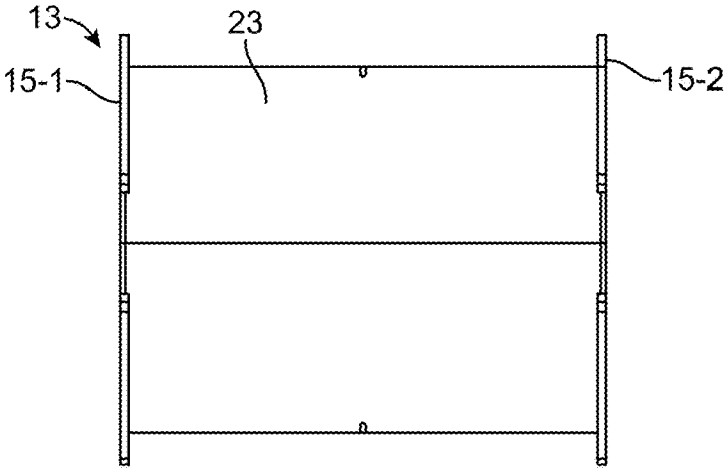

Referring now to FIGS. 1(*a*) and 1(*b*), there are shown assembled and exploded front perspective views, respectively, of a first embodiment of a cable reel constructed according to the teachings of the present invention, the cable reel being identified generally by reference numeral 11. As will be explained in detail below, cable reel 11 is constructed of an inexpensive plastic material and is uniquely designed to allow for variability of its strength to accommodate different products.

In the description that follows, reel 11 is described as being designed for use in winding a length of cable, such as fiberoptic cable. However, it should be noted that reel 11 is not limited to use with cable. Rather, it is to be understood that reel 11 could be utilized to retain any continuous filament-like product, such as wire, thread, fiber, or the like, without departing from the spirit of the present invention.

As seen most clearly in FIG. 1(*b*), cable reel 11 comprises (i) a tubular core, or drum, 13 with first and second sets of radial tabs 15 integrally formed at each of its ends, (ii) a disc-shaped, interior support flange 17 fixedly mounted within the interior of drum 13 to provide enhanced structural rigidity thereto, (iii) a pair of annularly-shaped inner flanges 19-1 and 19-2 coaxially mounted on core 13, with one flange 19 disposed in direct abutment against the inner surface of a corresponding set of tabs 15, and (iv) a pair of disc-shaped outer flanges 21-1 and 21-2, with one outer flange 21 affixed to the outer surface of a corresponding inner flange 19 over its associated tabs 15 in order to secure the components together. It should be noted that the multi-flange construction utilized at each end of drum 13 allows for the material properties and thickness of the resultant flange to be modified, as needed, to meet any variances in strength required in the intended application, which is a principal object of the present invention.

Referring now to FIGS. 2(*a*)-(*d*), tubular core 13 is constructed from a single sheet blank of corrugated plastic material. As can be appreciated, the use of an inexpensive plastic material to form most, if not all, of the various components of cable reel 11 serves to significantly reduce manufacturing costs, which is a principal object of the present invention.

As can be seen, the single sheet blank is rolled into a closed tube to create a central, cylindrical barrel 23 which is shaped to define an interior cavity 25. Ends 27-1 and 27-2 of the single sheet blank are affixed together to secure the shape of barrel 23 and form a strengthening rib 29 which extends longitudinally within interior cavity 25 and assists in maintaining adequate structural rigidity to barrel 23, as will be explained later.

First and second sets of radial tabs 15-1 and 15-2 are integrally formed onto open ends 23-1 and 23-2, respectively, of barrel 23. In the present embodiment, each set includes four, equidistantly arranged, arcuate-shaped tabs 15 that are integrally formed onto an end of barrel 23. Each tab 15 includes a neck portion, or neck, 31 of reduced width which enables each tab 15 to be selectively bent from its initial orientation to an approximate right angle relative to barrel 23, as shown herein.

It should be noted that core 13 is not limited to the particular number, shape, and arrangement of tabs 15 as shown herein. Rather, it is to be understood that the number, shape, and/or arrangement of tabs 15 on core 13 could be modified without departing from the spirit of the present invention.

As seen most clearly in FIGS. 2(*a*) and 2(*c*), a shortened slot 33 is formed in each side of barrel 23 at its approximate midpoint. As will be explained further below, slots 33 assist in retaining interior support flange 17 in place within interior cavity 25 of core 13.

Figure 3:
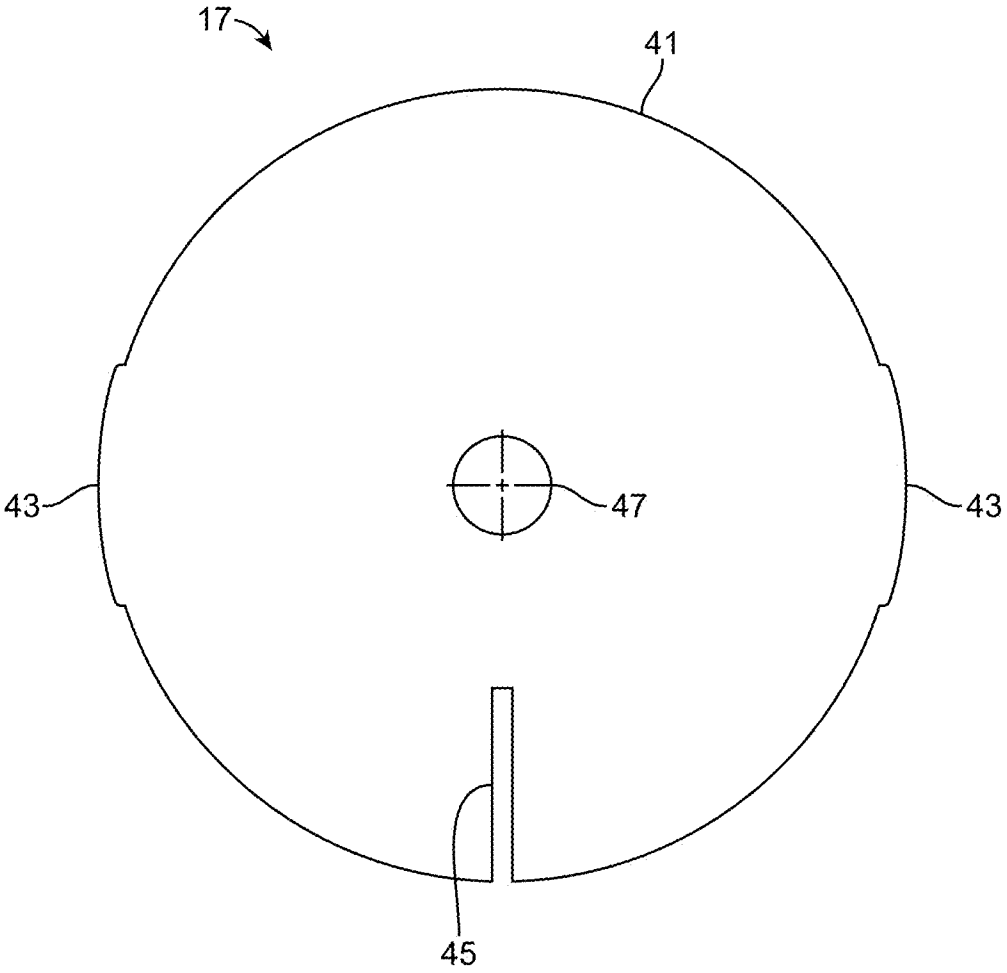
FIG. 3 is a left end view of the disc-shaped, interior support flange shown in FIG. 1(*b*)

Referring now to FIG. 3, interior support flange 17 is shown in isolation. As can be seen, interior support flange, or support, 17 is constructed as a unitary, disc-shaped member 41. Preferably, support 17 is made from an inexpensive and durable material, such as corrugated plastic.

A pair of arcuate protrusions 43 is formed on opposite sides of disc-shaped member 41. Additionally, a radial slot 45 is formed in disc-shaped member 41 along its bottom edge. Lastly, a circular hole 47 is formed in disc-shaped member 41 at its approximate center point.

In use, support 17 is designed to be fixedly inserted into interior cavity of tubular core 13 and provide structural reinforcement thereto. Disposed as such, protrusions 43 extend partially through slots 33 in barrel 23 to help retain support 17 in place. Additionally, slot 45 in disc-shaped member 41 is dimensioned to fittingly receive longitudinal rib 29 of core 13 through a snap-in-place locking mechanism.

Preferably, the outer diameter of disc-shaped member 41 is approximately equal to the inner diameter of tubular core 13. As a result, support 17 makes circumferential contact against the interior wall of barrel 23 and therefore provides the requisite structural integrity to core 13 to enable a cable (not shown) to be tightly wound thereon. The inclusion of hole 47 in support 17 enables a spindle (not shown) to be axially inserted through cable reel 11.

Figure 4B:
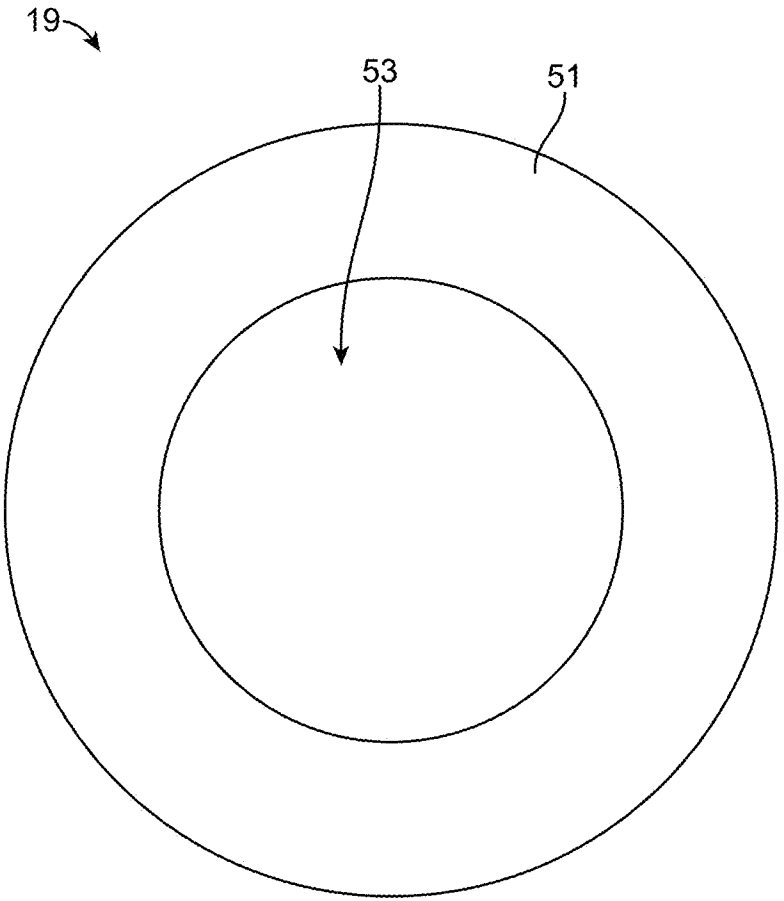
FIGS. 4(*a*) and 4(*b*) are front and left end views, respectively, of one of the inner flanges shown in FIG. 1(*b*)
Figure 4A:
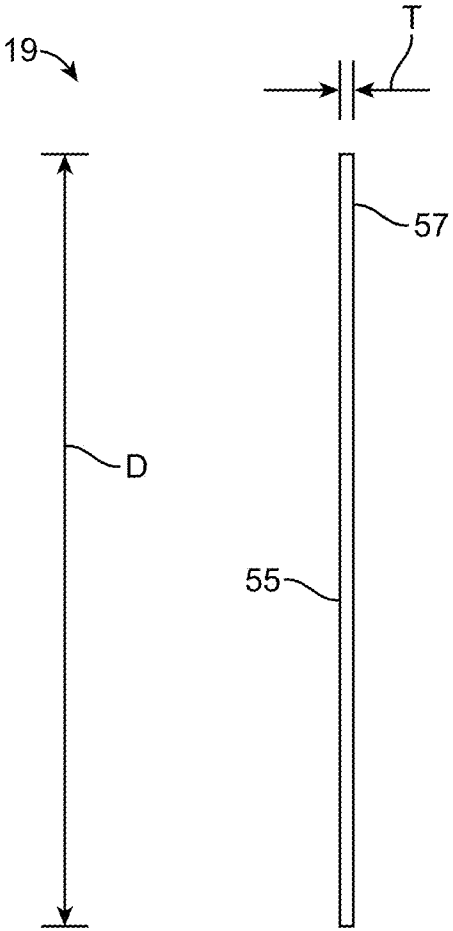

Referring now to FIGS. 4(*a*) and 4(*b*), an inner flange 19 is shown in isolation. As can be seen, inner flange 19 is constructed as a unitary, annular member 51 which is shaped to define a circular center hole 53, member 51 comprising a flattened outer surface 55 and a flattened inner surface 57. Preferably, member 51 is made from an inexpensive and durable material, such as corrugated plastic.

In use, inner flange 19 is designed to be axially mounted over barrel 23 of tubular core 13. As seen in FIG. 1(*b*), inner flange 19 is preferably disposed along barrel 23 such that its outer surface 55 abuts directly against a corresponding set of tabs 15.

As a feature of the present invention, aspects of inner flange 19 may be modified based on the strength requirements of the intended application. For instance, the density of the corrugated plastic material used to form inner flange 19 may be modified to enhance its strength. Additionally, as shown in FIG. 4(*a*), the thickness T and/or the diameter D of inner flange 19 may be increased to improve the overall strength of the resultant cable reel without changing any other of its principal components.

Figure 5B:
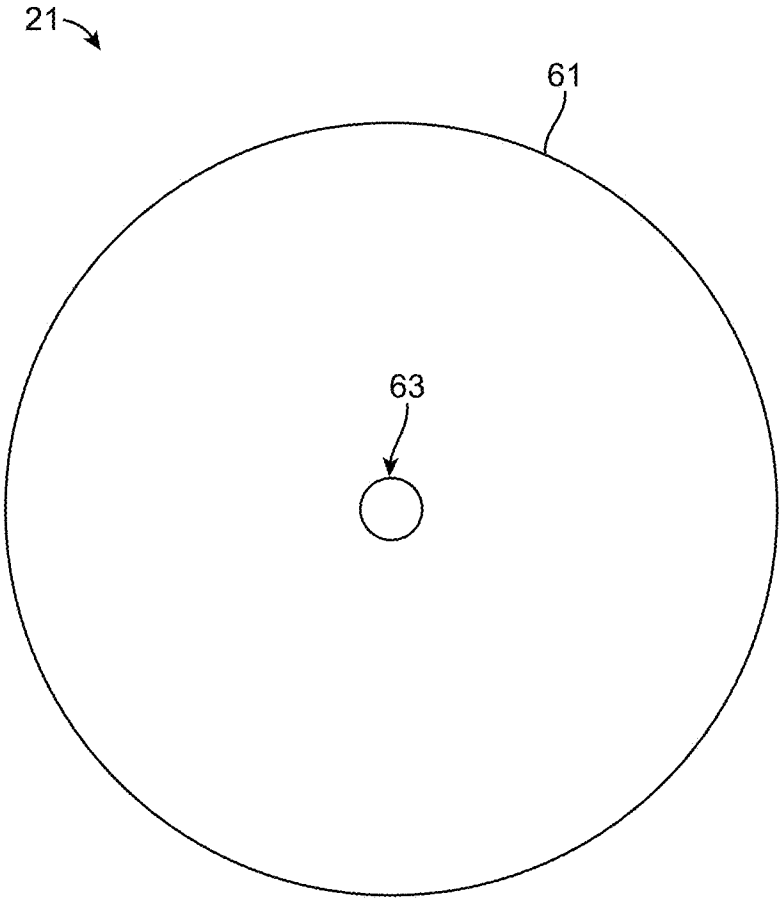
FIGS. 5(*a*) and 5(*b*) are front and left end views, respectively, of one of the outer flanges shown in FIG. 1(*b*)
Figure 5A:
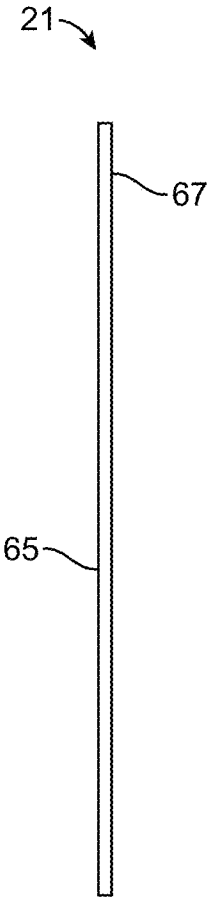

Referring now to FIGS. 5(*a*) and 5(*b*), an outer flange 21 is shown in isolation. As can be seen, outer flange, or end cover, 21 is constructed as a unitary, disc-shaped member 61 which is shaped to define a circular center hole 63, member 61 comprising a flattened outer surface 65 and a flattened inner surface 67. Preferably, member 61 is made from an inexpensive and durable material, such as corrugated plastic.

In use, each end cover 21 is designed to coaxially align with its corresponding inner flange 19, with inner surface 67 of end cover 21 directly facing outer surface 55 of its corresponding inner flange 19. In turn, end cover 21 and inner flange 19 are secured together by any suitable means (e.g., using an adhesive, through welding, or the like), with the set of radial tabs 15 sandwiched therebetween. By fixedly securing together end cover 21, inner flange 19, and radial tabs 15, a multi-piece flange is effectively created which is fixed in place on each end of barrel 23. As previously referenced, the strength of the resultant multi-piece flange (and, in turn, the overall strength of cable reel 11) can be easily modified by changing characteristics of inner flange 19 (e.g., material density, thickness, and/or outer diameter).

Design Modifications and Alternate Embodiments

The invention described in detail above is intended to be merely exemplary and those skilled in the art shall be able to make numerous variations and modifications to it without departing from the spirit of the present invention. All such variations and modifications are intended to be within the scope of the present invention as defined in the appended claims.

Figure 6A:
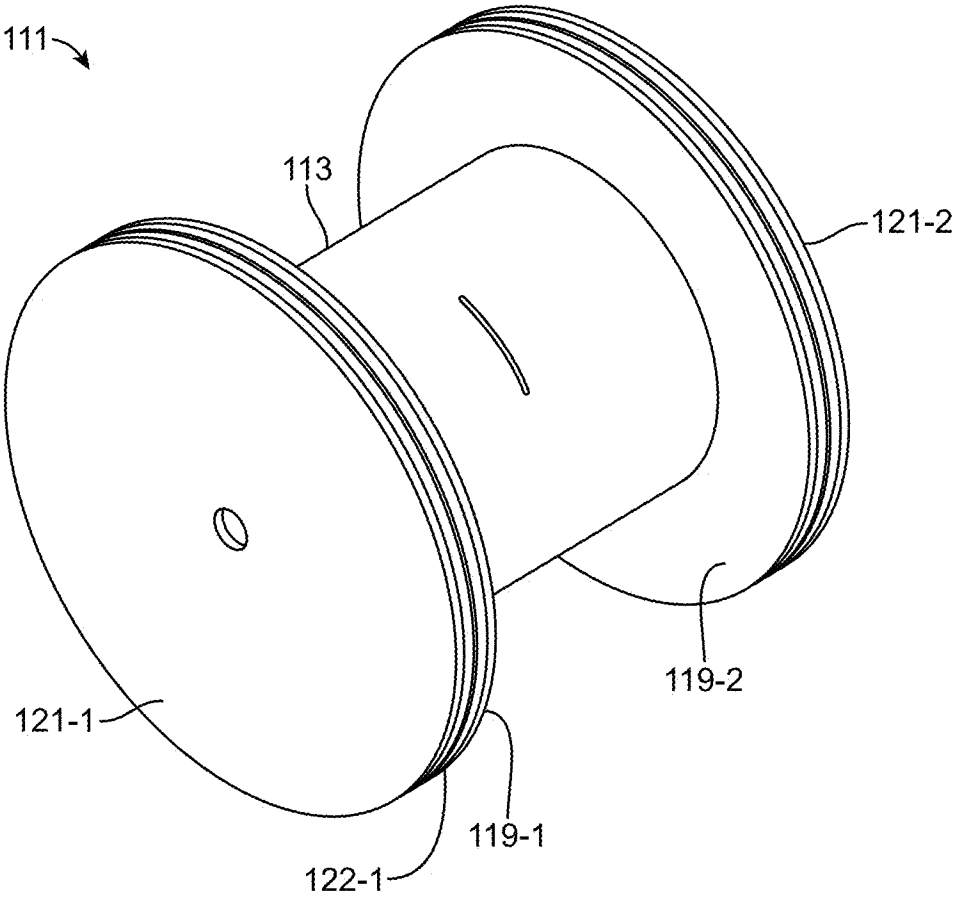
FIGS. 6(*a*) and 6(*b*) are assembled, front perspective and exploded, front perspective views, respectively, of a second embodiment of a cable reel constructed according to the teachings of the present invention.
Figure 6B:
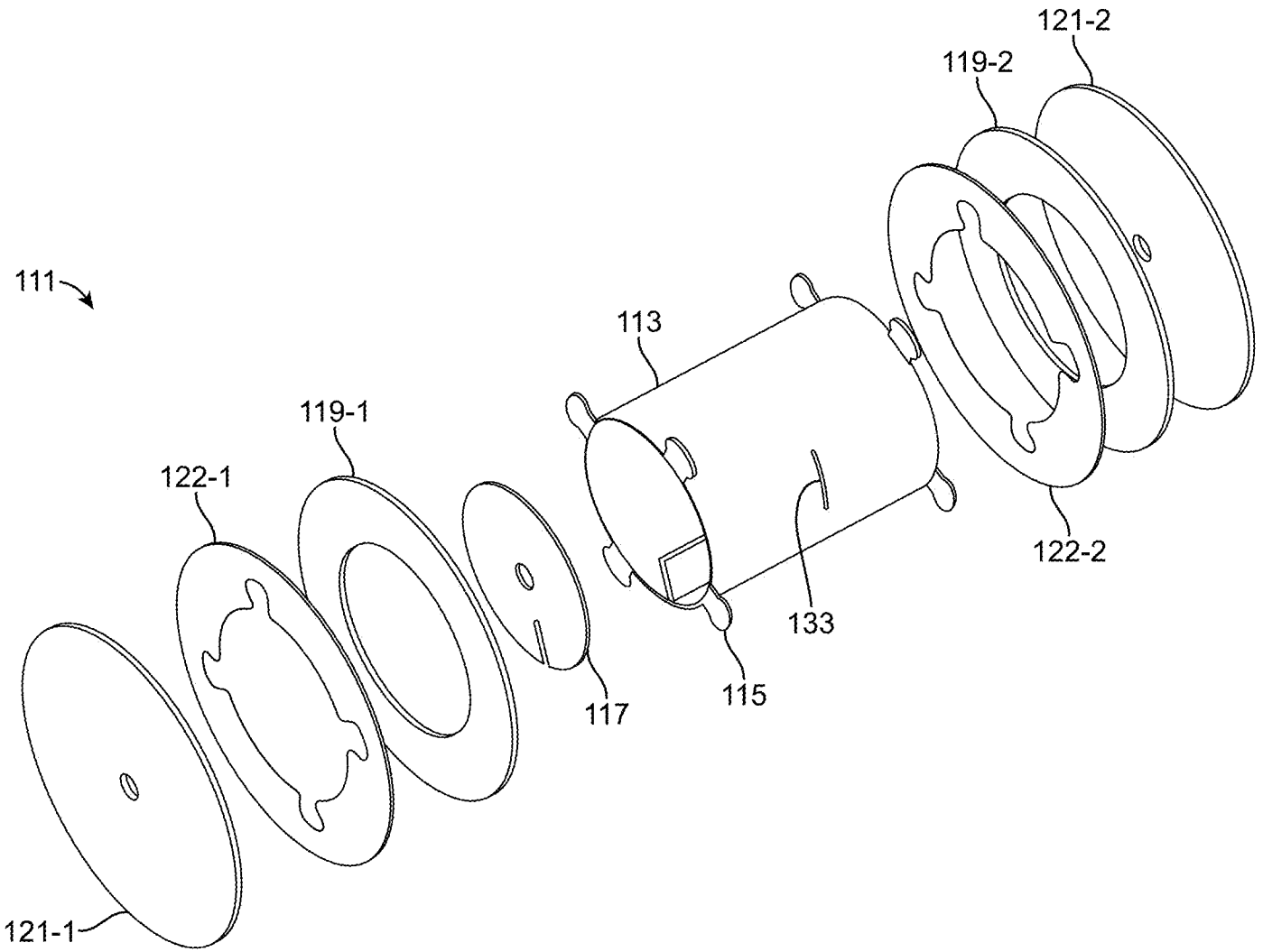
Figure 7A:
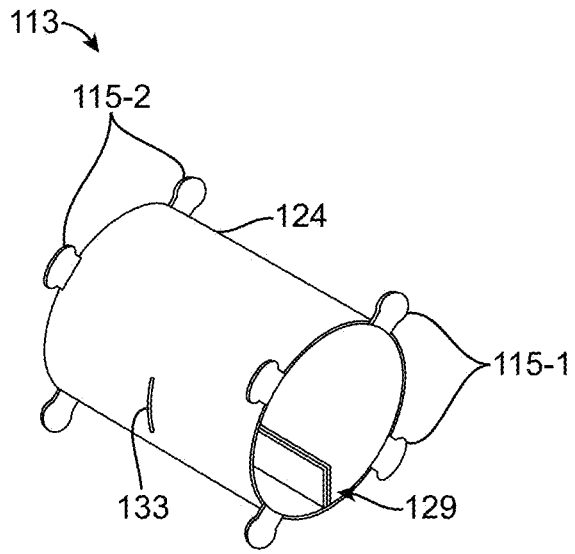
FIGS. 7(*a*)-7(*d*) are rear perspective, top, left end, and front views, respectively, of the tubular core shown in FIG. 6(*b*)
Figure 7B:
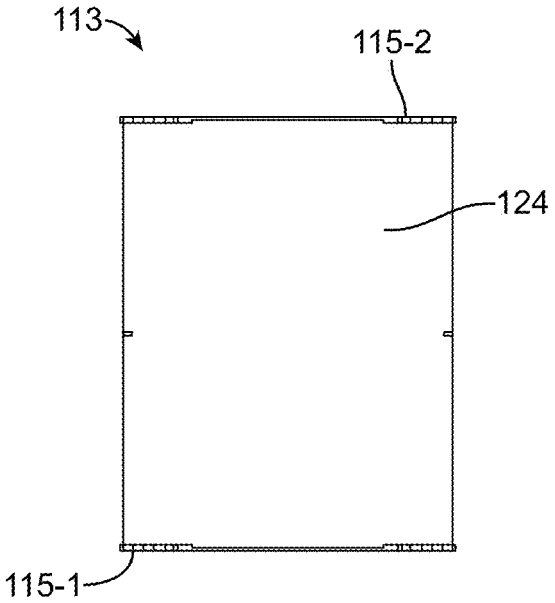
Figure 7C:
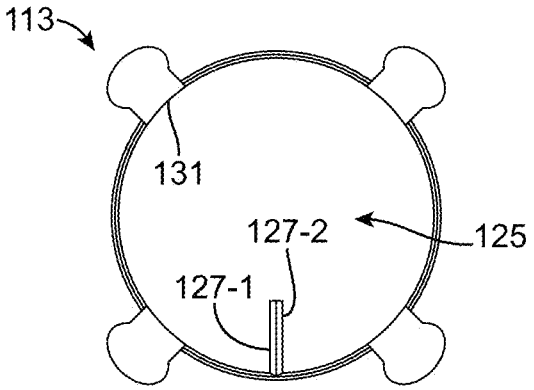
Figure 7D:
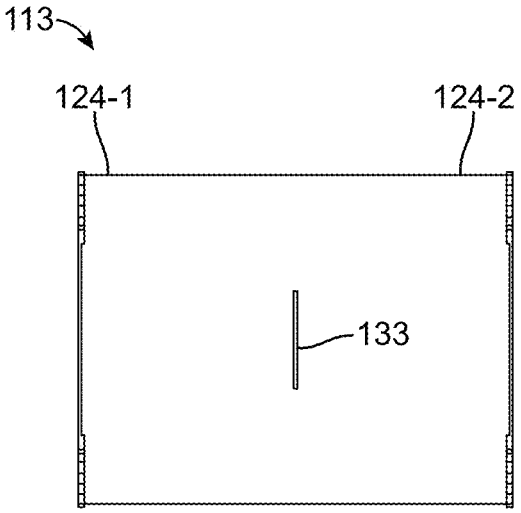

For example, referring now to FIGS. 6(*a*) and 6(*b*), there are shown assembled and exploded front perspective views, respectively, of a second embodiment of a cable reel constructed according to the teachings of the present invention, the cable reel being identified generally by reference numeral 111.

Cable reel 111 is similar to cable reel 11 in that cable reel 111 comprises (i) a tubular core, or drum, 113 with first and second sets of radial tabs 115 integrally formed at each of its ends, (ii) a disc-shaped, interior support flange 117 fixedly mounted within the interior of drum 113 to provide enhanced structural rigidity thereto, (iii) a pair of annularly-shaped inner flanges 119-1 and 119-2 coaxially mounted on core 113, with one flange 119 disposed in direct abutment against the inner surface of a corresponding set of tabs 115, and (iv) a pair of disc-shaped outer flanges 121-1 and 121-2, with one outer flange 121 affixed to the outer surface of a corresponding inner flange 119 over its associated tabs 115 in order to secure the components together. Also similar to cable reel 11, cable reel 111 is preferably constructed of an inexpensive plastic material and is uniquely designed to allow for variability of its strength to accommodate different products. More specifically, the multi-flange construction utilized at each end of drum 113 allows for the material properties and thickness of the resultant flange to be modified, as needed, to meet any variances in strength required in the intended application.

Cable reel 111 differs primarily from cable reel 11 in (i) the construction of tubular core 113, and (ii) the addition of a pair of spacer flanges, or spacers, 122-1 and 122-2 to minimize any gaps, or spacing, between inner flange 119 and its complementary outer flange 121.

Figure 8B:
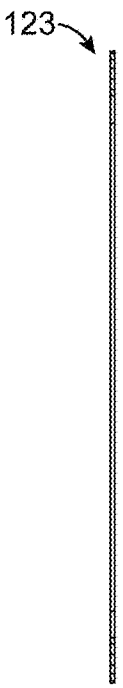
FIGS. 8(*a*) and 8(*b*) are front plan and left end views, respectively, of a blank used to construct the tubular core shown in FIG. 7(*a*)
Figure 8A:
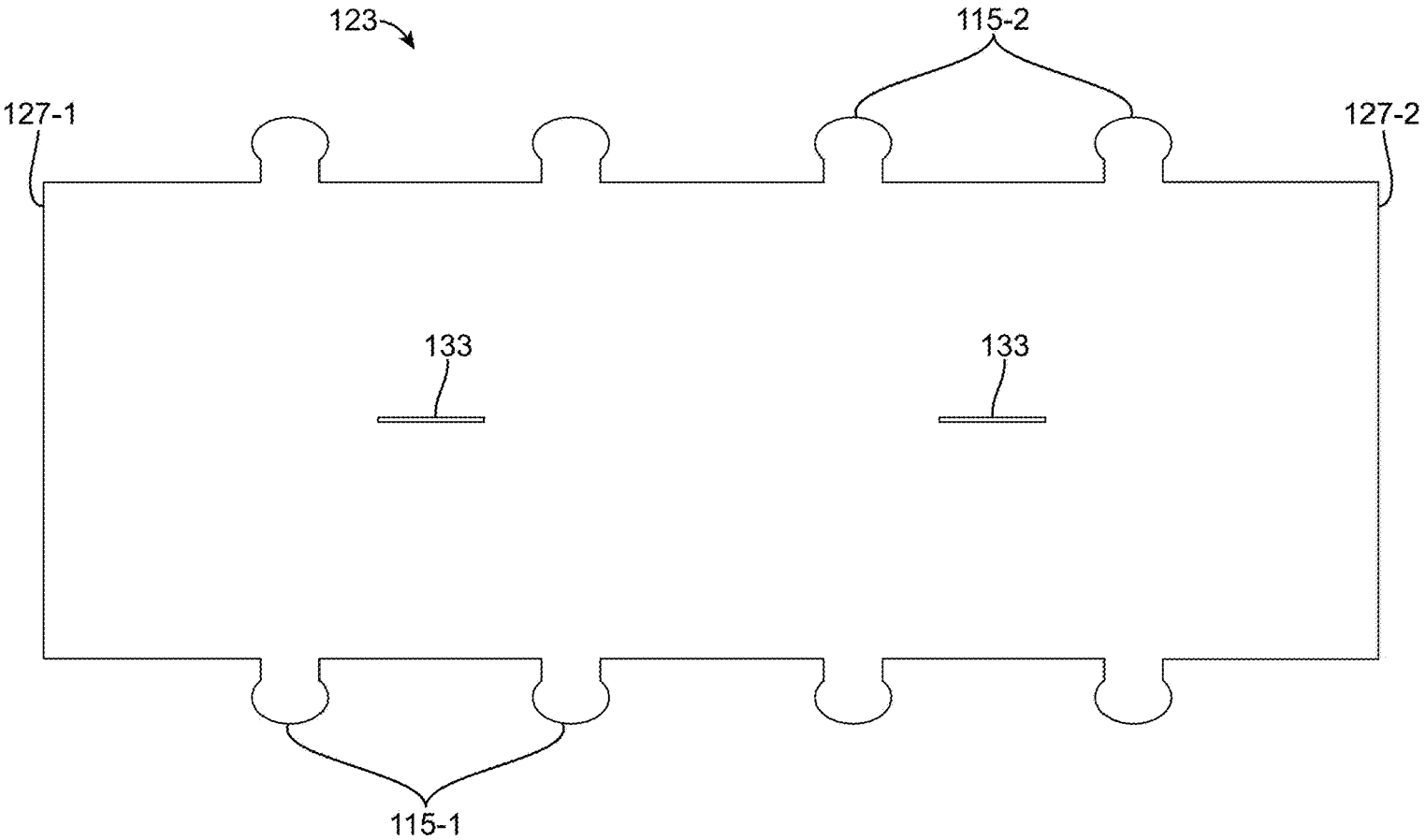

Referring now to FIGS. 7(*a*)-(*d*) and FIGS. 8(*a*)-(*b*), tubular core 113 is similar to tubular core 13 in that tubular core 113 is constructed from a single sheet blank 123 of corrugated plastic material, as seen most clearly in FIG. 8(*a*). As can be appreciated, the use of an inexpensive plastic material to form most, if not all, of the various components of cable reel 111 serves to significantly reduce manufacturing costs, which is a principal object of the present invention.

As seen most clearly in FIGS. 7(*a*)-(*d*), single sheet blank 123 is rolled into a closed tube to create a central, cylindrical barrel 124 which is shaped to define an interior cavity 125. Ends 127-1 and 127-2 of single sheet blank 123 are affixed together to secure the shape of barrel 124 and form a longitudinal strengthening rib 129 which assists in maintaining adequate structural rigidity to barrel 124.

Core 113 is also similar to core 13 in that first and second sets of radial tabs 115-1 and 115-2 are integrally formed onto open ends 124-1 and 124-2, respectively, of barrel 124. However, although each set includes four, equidistantly arranged tabs 115, the shape of each tab 115 differs from the shape of tab 15. Notably, each tab 115 has a bulbous shape of limited surface area, for reasons to become apparent below. Tab 115 is integrally formed onto an end of barrel 124 through a neck portion, or neck, 131 of reduced width. Accordingly, each tab 115 is adapted to be selectively bent from its initial orientation to an approximate right angle relative to barrel 124.

Finally, core 113 is similar to core 13 in that a shortened slot 133 is formed in each side of barrel 124 at its approximate midpoint. As can be appreciated, slots 133 assist in retaining interior support flange 117 in place within interior cavity 125 of core 113.

Figure 9:
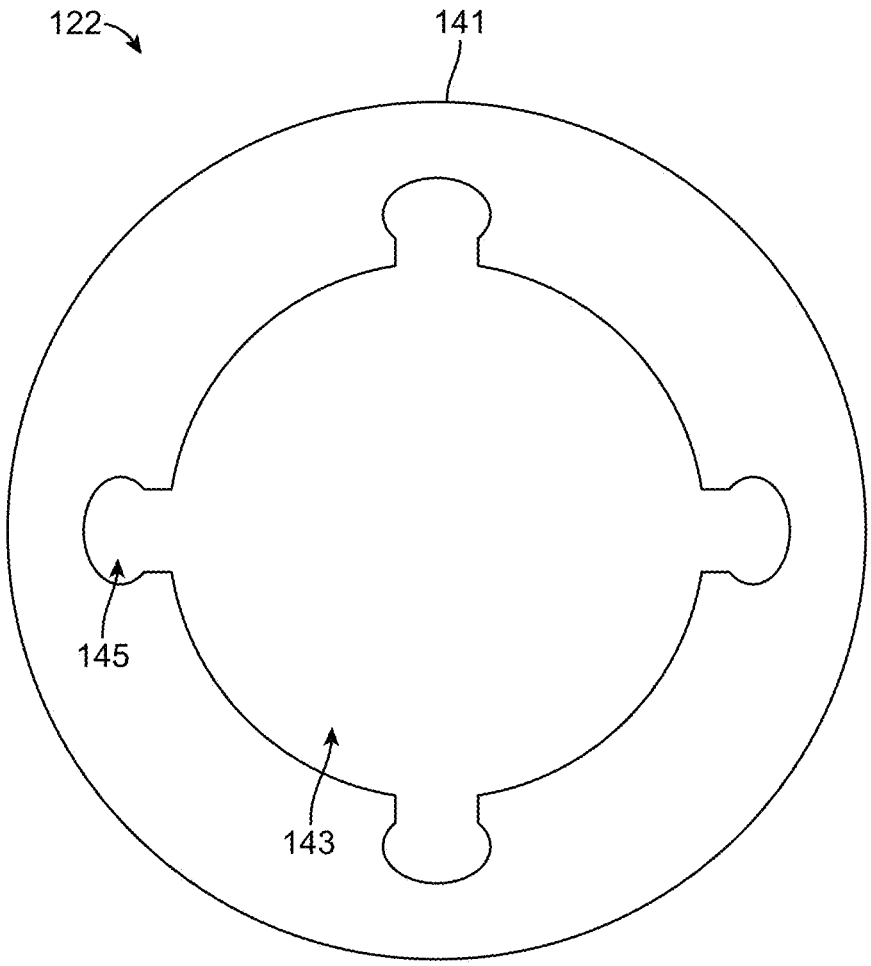
FIG. 9 is a left end view of the spacer flange shown in FIG. 6(*b*)

Referring now to FIG. 9, a spacer 122 is shown in isolation. As can be seen, spacer 122 is constructed as a unitary, disc-shaped member 141. Preferably, spacer 122 is made from an inexpensive and durable material, such as corrugated plastic.

A central hole 143 is formed in disc-shaped member 141 which enables spacer 122 to be coaxially mounted onto one end of barrel 124. Hole 143 includes four bulbous cutouts 145 which are dimensioned to fittingly receive tabs 115 when cable reel 111 is in its assembled form. In this capacity, spacers 122 serve to minimize any gaps, or spacing, between inner flange 119 and its complementary outer flange 121. Furthermore, because spacer 122 helps bond together inner flange 119 and outer flange 121, the surface area of tabs 115 can be significantly reduced.

Figure 10A:
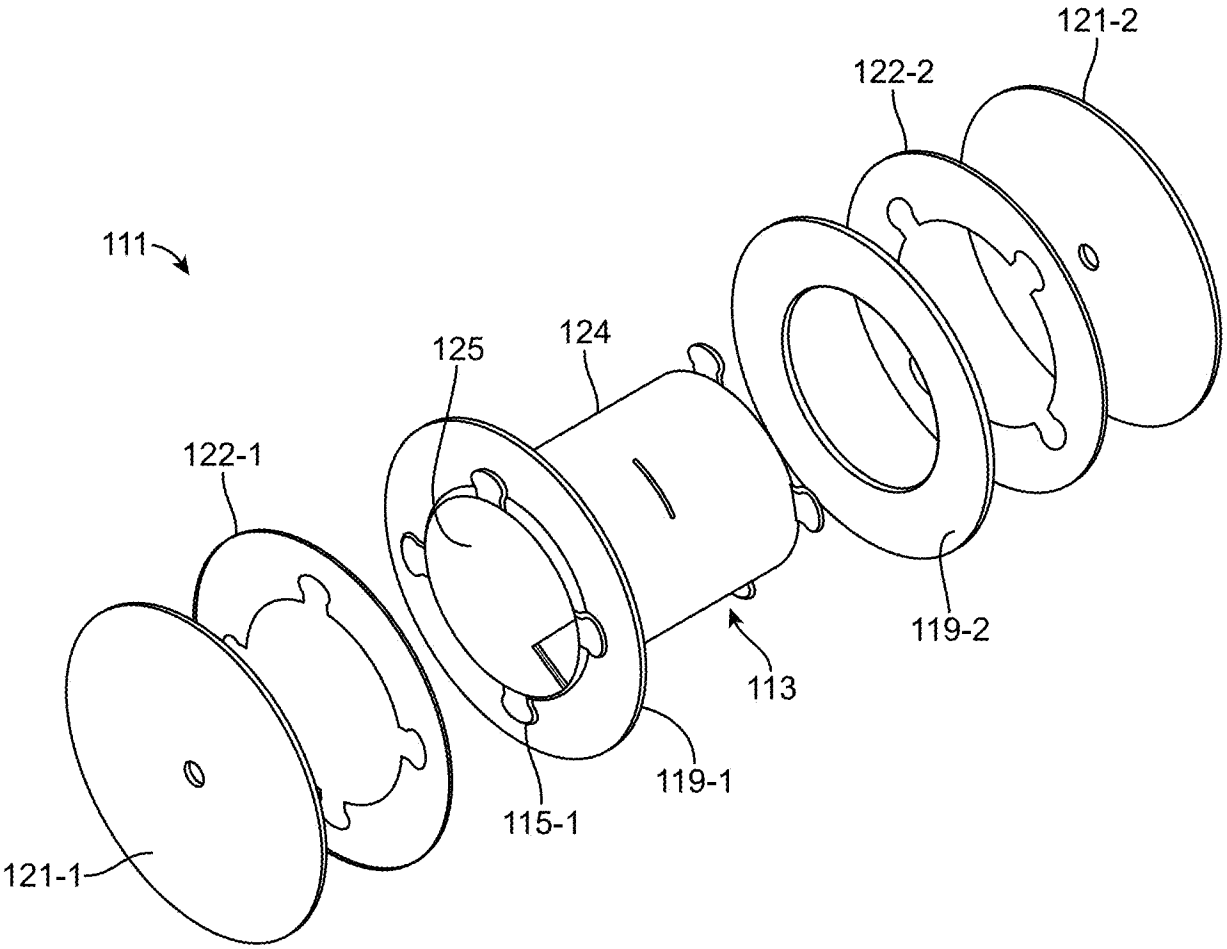
FIGS. 10(*a*)-(*c*) are a series of front perspective views of the cable reel shown in FIG. 6(*a*) at various stages of its assembly.
Figure 10B:
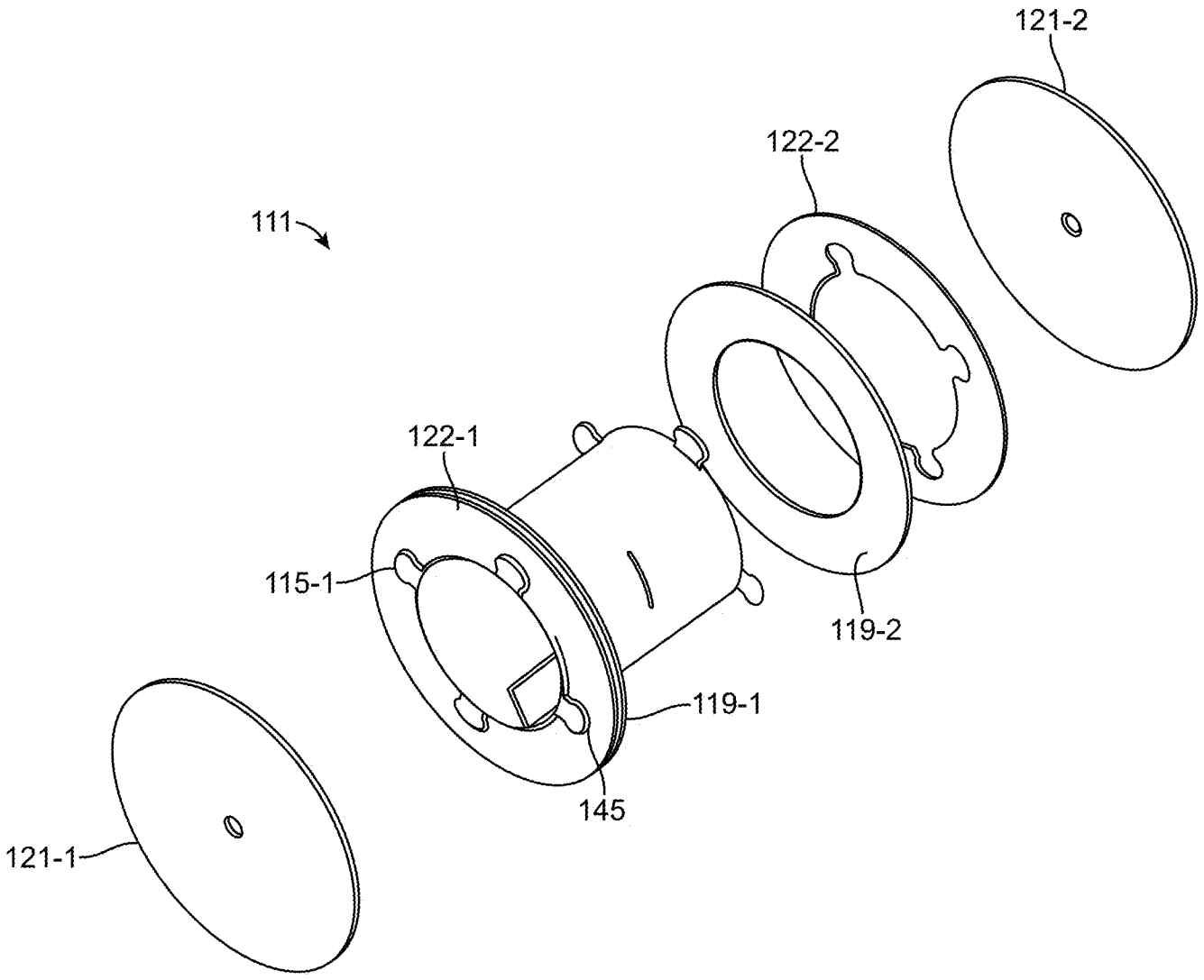
Figure 10C:
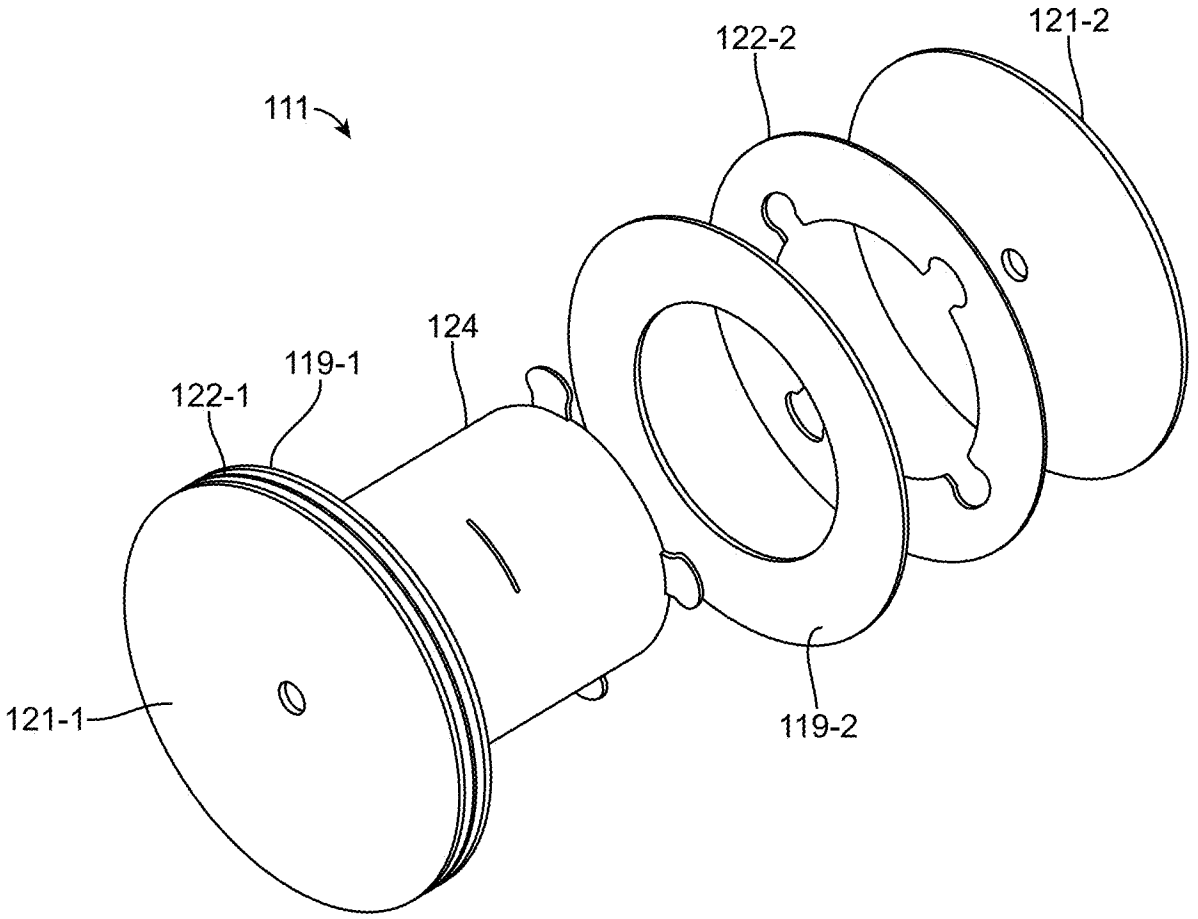

Referring now to FIGS. 10(*a*)-(*c*), there is shown a series of front perspective views of cable reel 111 at various stages of its assembly. Although not shown herein, interior support flange 117 is preferably inserted into interior cavity 125 of barrel 124 and locked in place to provide structural rigidity to core 113. Thereafter, first set of tabs 115-1 are temporarily articulated so as to extend in parallel to the longitudinal axis of barrel 124. With tabs 115-1 configured as such, inner flange 119-1 is axially mounted onto barrel 124. Then, tabs 115-1 are returned to an orthogonal orientation relative to barrel 124. Lastly, inner flange 119-1 is then slid along barrel 124 so as to directly abut against first set of tabs 115-1, as shown in FIG. 10(*a*).

With inner flange 119-1 mounted as such, spacer 122-1 is mounted over core 113, as shown in FIG. 10(*b*). Because spacer 122-1 is designed to match the profile of tabs 115-1, each tab 115 fittingly aligns within a corresponding cutout 145. Preferably, the thickness of tabs 115 matches the thickness of spacer 122, thereby together yielding a continuous, planar surface.

As seen in FIG. 10(*c*), end cover 121-1 is disposed flush against spacer 122-1 and tabs 115-1 in coaxial alignment therewith. Thereafter, inner flange 119-1, tabs 115-1, spacer 122-1, and end cover 121-1 are all secured together, such as through a welding process to yield a unitary, flange-like member on the end of core 113. Although not shown herein, it is to be understood that inner flange 119-2, spacer 122-2, and end cover 121-2 are all mounted onto the opposite end of core 113 in a similar fashion.

As previously referenced, aspects of inner flanges 119 may be modified based on the strength requirements of the intended application. For instance, the density of the corrugated plastic material used to form each inner flange 119 may be modified to enhance its strength. Additionally, the thickness and/or diameter of inner flange 119 may be increased to improve the overall strength of the resultant cable reel without changing any other of its principal components.

What is claimed is:

1. A cable reel for retaining a length of product, the cable reel comprising:

(a) a tubular core comprising, (i) a cylindrical barrel shaped to define an interior cavity, the barrel comprising an inner surface, an outer surface, a first end, and a second end, (ii) a first set of radial tabs formed on the first end of the barrel, each of the first set of radial tabs having an inner surface and an outer surface, and (iii) a second set of radial tabs formed on the second end of the barrel, each of the second set of radial tabs having an inner surface and an outer surface, (iv) wherein each of the first and second sets of radial tabs projects orthogonally outward relative to the outer surface of the cylindrical barrel;

(b) first and second inner flanges coaxially mounted on the barrel of the tubular core, the first inner flange disposed flush against the inner surface of the first set of radial tabs and the second inner flange disposed flush against the inner surface of the second set of radial tabs;

(c) first and second outer flanges, the first outer flange disposed flush against the outer surface of the first set of radial tabs and the second outer flange disposed flush against the outer surface of the second set of radial tabs; and (d) an interior support flange mounted within the interior cavity of the barrel to provide enhanced structural rigidity to the tubular core, the interior support flange being generally disc shaped and including an outer edge, wherein at least a portion of the outer edge contacts the inner surface of the barrel to provide structural rigidity to the tubular core, the outer edge of the interior support flange including a pair of outward protrusions dimensioned to fittingly project through a corresponding pair of slots formed in the barrel of the tubular core;

(e) wherein the first inner flange is fixedly secured to the first outer flange with the first set of radial tabs sandwiched therebetween and the second inner flange is fixedly secured to the second outer flange with the second set of radial tabs sandwiched therebetween.

2. The cable reel as claimed in claim 1 wherein each of the first and second set of tabs is adapted to pivot relative to the cylindrical barrel.

3. The cable reel as claimed in claim 1 wherein the tubular core is formed from a single sheet blank having first and second ends.

4. The cable reel as claimed in claim 3 wherein the single sheet blank is constructed of a corrugated plastic material.

5. A cable reel for retaining a length of product, the cable reel comprising:

(a) a tubular core comprising, (i) a cylindrical barrel shaped to define an interior cavity, the barrel comprising an inner surface, an outer surface, a first end, and a second end, (ii) a first set of radial tabs formed on the first end of the barrel, each of the first set of radial tabs having an inner surface and an outer surface, and (iii) a second set of radial tabs formed on the second end of the barrel, each of the second set of radial tabs having an inner surface and an outer surface, (iv) wherein each of the first and second set of radial tabs projects orthogonally outward relative to the outer surface of the cylindrical barrel, (v) wherein the tubular core is formed from a single sheet blank having first and second ends, the single sheet blank being rolled into a closed tube to form the tubular core, the blank being retained in shape by affixing the first and second ends together to form a strengthening rib which extends longitudinally within the interior cavity of the barrel;

(b) first and second inner flanges coaxially mounted on the barrel of the tubular core, the first inner flange disposed flush against the inner surface of the first set of radial tabs and the second inner flange disposed flush against the inner surface of the second set of radial tabs; and (c) first and second outer flanges, the first outer flange disposed flush against the outer surface of the first set of radial tabs and the second outer flange disposed flush against the outer surface of the second set of radial tabs;

(d) an interior support flange mounted within the interior cavity of the barrel to provide enhanced structural rigidity to the tubular core, the interior support flange being generally disc shaped and including an outer edge, wherein at least a portion of the outer edge contacts the inner surface of the barrel to provide structural rigidity to the tubular core, wherein the outer edge of the interior support flange has an inward radial slot which is dimensioned to receive the strengthening rib;

(e) wherein the first inner flange is fixedly secured to the first outer flange with the first set of radial tabs sandwiched therebetween and the second inner flange is fixedly secured to the second outer flange with the second set of radial tabs sandwiched therebetween.

6. A cable reel for retaining a length of product, the cable reel comprising:

(a) a tubular core comprising, (i) a cylindrical barrel shaped to define an interior cavity, the barrel comprising an inner surface, an outer surface, a first end, and a second end, (ii) a first set of radial tabs formed on the first end of the barrel, each of the first set of radial tabs having an inner surface and an outer surface, and (iii) a second set of radial tabs formed on the second end of the barrel, each of the second set of radial tabs having an inner surface and an outer surface, (iv) wherein each of the first and second sets of radial tabs projects orthogonally outward relative to the outer surface of the cylindrical barrel;

(b) first and second inner flanges coaxially mounted on the barrel of the tubular core, wherein each of the first and second inner flanges is annular and disc-shaped, the first inner flange disposed flush against the inner surface of the first set of radial tabs and the second inner flange disposed flush against the inner surface of the second set of radial tabs;

(c) first and second outer flanges, the first outer flange disposed flush against the outer surface of the first set of radial tabs and the second outer flange disposed flush against the outer surface of the second set of radial tabs; and (d) first and second spacers coaxially mounted on the barrel, the first spacer being mounted over the first set of radial tabs and the second spacer being mounted over the second set of radial tabs;

(e) wherein the first inner flange is fixedly secured to the first outer flange in coaxial alignment with the first set of radial tabs sandwiched therebetween and the second inner flange is fixedly secured to the second outer flange in coaxial alignment with the second set of radial tabs sandwiched therebetween.

7. The cable reel as claimed in claim 6 wherein the first spacer is generally annular and includes a plurality of cutouts which fittingly receive the first set of radial tabs.

8. The cable reel as claimed in claim 7 wherein the second spacer is generally annular and includes a plurality of cutouts which fittingly receive the second set of radial tabs.

9. The cable reel as claimed in claim 8 wherein the first spacer and the first set of radial tabs are approximately equal in thickness, and the second spacer and the second set of radial tabs are approximately equal in thickness.

* * * * *